United States Patent [19]

Haraden

[11] Patent Number: 4,624,513

[45] Date of Patent: Nov. 25, 1986

[54] LAMP HOLDER ASSEMBLY HAVING ROTATABLE BASE SHELL

[75] Inventor: Thomas Haraden, Ipswich, Mass.

[73] Assignee: GTE Products Corporation, Stamford, Conn.

[21] Appl. No.: 722,946

[22] Filed: Apr. 12, 1985

[51] Int. Cl.[4] ..... H01R 39/00

[52] U.S. Cl. ..... 339/1 L; 339/2 L; 339/8 PS; 339/54; 339/182 L

[58] Field of Search ..... 339/176 L, 144–146, 339/68, 1 R, 1 L, 2 R, 2 L, 8 R, 8 P, 8 A, 8 PB, 8 PS, 9 R, 9 RY, 82–87, 54; 313/318, 324, 149

[56] References Cited

U.S. PATENT DOCUMENTS

| | | | |
|---|---|---|---|
| 2,138,780 | 11/1938 | Birdseye | 339/146 |
| 2,235,656 | 3/1941 | Thal | 339/8 R |
| 2,871,455 | 1/1959 | Richardson | 339/8 R |
| 4,198,112 | 4/1980 | Miller | 339/176 L |
| 4,258,287 | 3/1981 | Hetzel | 315/58 |
| 4,347,460 | 8/1982 | Latasse et al. | 315/63 |
| 4,405,877 | 9/1983 | Haraden et al. | 313/318 |
| 4,406,969 | 9/1983 | Haraden et al. | 313/318 |
| 4,565,944 | 1/1986 | Beurskans et al. | 313/318 |

FOREIGN PATENT DOCUMENTS

| | | | |
|---|---|---|---|
| 854225 | 4/1959 | United Kingdom | 339/2 L |

*Primary Examiner*—Gil Weidenfeld
*Assistant Examiner*—David L. Pirlot
*Attorney, Agent, or Firm*—Carlo S. Bessone

[57] ABSTRACT

A lamp holder assembly includes a first housing having a central body portion and a protruding portion surrounded by a base shell and a retainer member secured to the protruding portion of the first housing. A means for permitting a predetermined amount of rotational movement of the base shell relative to the protruding portion and the retainer member is provided.

20 Claims, 9 Drawing Figures

LAMP HOLDER ASSEMBLY HAVING ROTATABLE BASE SHELL

TECHNICAL FIELD

This invention relates to lamp holder assemblies and more particularly to such assemblies employed for fitting lamps to the sockets of incandescent lamp fixtures.

BACKGROUND OF THE INVENTION

Because of the increasing cost of electrical energy the substitution of initially costlier but more energy efficient lamp types in place of incandescent lamps has become practical. A prime candidate for this substitution is the fluorescent lamp, primarily because of its high luminous efficacy.

There are many lamp holder assemblies currently available which are adapted to fit incandescent sockets and to provide both mechanical support and electrical input power for various devices including fluorescent lamp systems. Many of these assemblies, however, require alignment of the housing with respect to the incandescent fixture or portable lamp to properly clear the harp used to support a lamp shade. Exemplary of such assembles are the devices shown in U.S. Pat. No. 4,347,460 which issued to Latassa et al on Aug. 31, 1982 and U.S. Pat. No. 4,406,969 which issued to Haraden et al on Sept. 27, 1983. The former mentioned patent shows a fluorescent lamp assembly having a rectangular-shaped housing which may require alignment depending on its dimensions. The latter patent shows a lamp holder assembly having a central body with a pair of projecting arms which may interfere with replacement of the harp. To rectify this condition it is necessary to partially unscrew the assembly, which can result in a loose mechanical fit in the socket and a poor electrical connection.

U.S. Pat. No. 4,405,877, which issued to Haraden et al on Sept. 20, 1983, shows a variably positional lamp holder assembly comprised of a housing having a lower portion carrying a base fixed to the housing in a manner to allow a limited amount of rotational movement of the base relative to the lower portion. The rotational movement of the base is accomplished by providing a circumferentially extending slot formed in the lower portion and a pin fixed on the base which projects into the slot. The width of the slot, which is a determining factor in the amount of rotational movement, is limited in order to retain structural integrity of the lower portion of the housing.

Other lamp holder assemblies available on the market are provided with a base which slips in one direction, i.e., that of tightening. At some point in tightening, the torque exerted overcomes the friction of the base shell threads allowing the housing to continue to rotate while the base is firmly seated in the socket. These assemblies which allow the base to slip are sometimes not dependable because of the variation in the amount friction among different units. Too little friction results in slippage occurring too soon and thus preventing proper connection to the center electrical contact. Too much friction allows overtightening of the lamp holder assembly and may cause distortion to the female threads of the incandescent socket.

SUMMARY OF THE INVENTION

It is, therefore, an object of the invention to obviate the disadvantages of the prior art.

It is another object of the invention to enhance the fitting of fluorescent lamps to the sockets of incandescent lamp fixtures.

These objects are accomplished, in one aspect of the invention, by the provision of a lamp holder assembly comprising a first housing having a central body portion and a protruding portion located at one end of the first housing, a base shell surrounding the protruding portion of the first housing, a retainer member secured to the protruding portion of the first housing and means for permitting a predetermined amount of rotational movement of the base shell relative to the protruding portion and the retainer member.

In accordance with further aspects of the present invention, the means for permitting rotational movement preferably includes a rib secured to or forming part of the base and projecting therefrom and a stop means secured to or forming part of the first housing and disposed relative to the base for engaging the rib at two spaced apart positions of movement of the rib. The spaced apart positions define the amount of rotational movement which preferably is about 180°.

In accordance with the teachings of the invention, the rib may be located on the internal surface of the base shell. In one embodiment, the stop means includes at least a first projecting member located on the first housing adjacent the internal surface of the base shell. The first projecting member is preferably arcuate in shape. Alternatively, in another embodiment, the stop means include two projecting members spacedly located on the first housing adjacent the internal surface of the base shell.

In accodance with the further teachings of the present invention, the rib is alternatively located on the external surface of the base shell. In a further embodiment, the stop means includes at least a first projecting member located on the first housing adjacent the external surface of the base shell. Preferably, the first projecting member in the present embodiment is arcuate in shape. Alternatively, in a still further embodiment, the stop means includes two projecting members spacedly located on the first housing adjacent the external surface of the base shell.

In accordance with additional aspects of this invention, the base shell preferably includes an insulative second housing having an electrically conductive shell attached thereto. The insulative second housing of the base shell may be provided with an external screw thread, and the electrically conductive shell may have an internal thread which mates therewith.

In accordance with additional aspects of this invention, the retainer member may include a disk-shaped portion having a first electrical contact means coaxially disposed therein and a resilient protruding member attached to first surface of the disk-shaped portion. The resilient protruding member of the retainer member projects longitudinally with a cavity defined by the protruding portion of the first housing. Preferably, the protruding portion of the first housing includes one or more tabs projecting longitudinally and the retainer member has one or more slots formed in the disk-shaped portions adjacent the first electrical contact means for receiving the associated tab or tabs. The internal surface of the protruding portion of the first housing may be provided with an inwardly extending circumferential rim, and the resilient protruding member of the retainer member may include a plurality of prongs. Also, each of the prongs preferably has an outwardly extendings ridge located at one end thereof for engaging the circumferential rim.

In accordance with still further aspects of this invention, the lamp holder may further include a second electrical contact means comprising an electrically conductive member secured to the retainer member and adapted to slidably contact the electrically conductive shell. This form of contact assures a positive electrical connection to the base shell when the base shell is being rotated with respect to the protruding portion and the retainer member. The electrically conductive member can include a longitudinally extending first portion, a laterally extending second portion attached to the first portion, a longitudinally extending third portion attached to the second portion and a laterally extending fourth portion attached to the third portion. Preferably, the electrically conductive member is secured to the retainer member by means of a pair of notches formed in the second portion which engage two adjacent prongs and a groove formed in a first surface of the disk-shaped portion of the retainer member to receive the third and fourth portions of the electrically conductive member.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
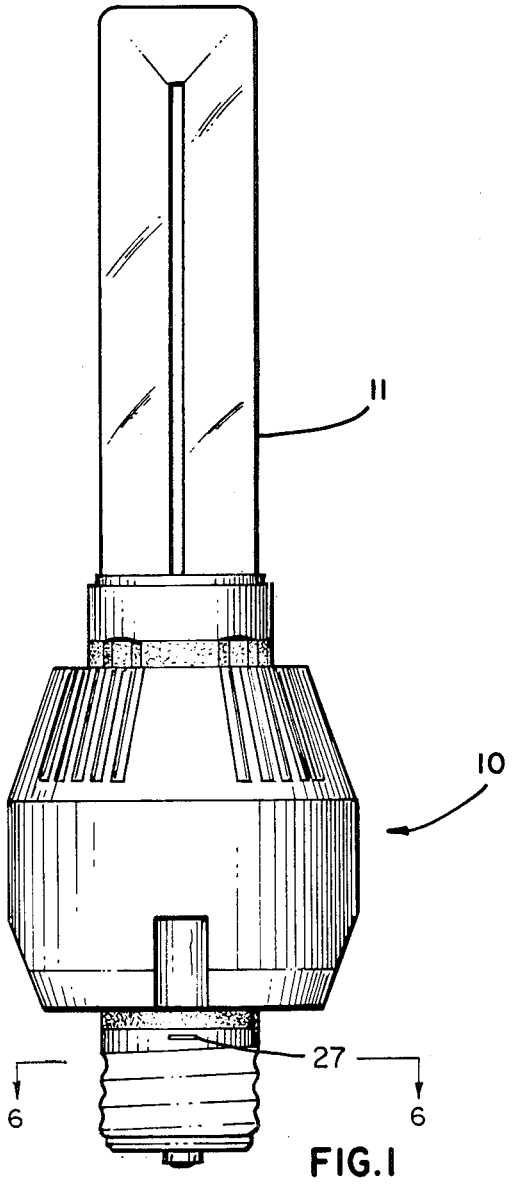
FIG. 1 is a front elevational view of an embodiment of a lamp holder assembly according to the invention with a lamp attached thereto.
Figure 2:
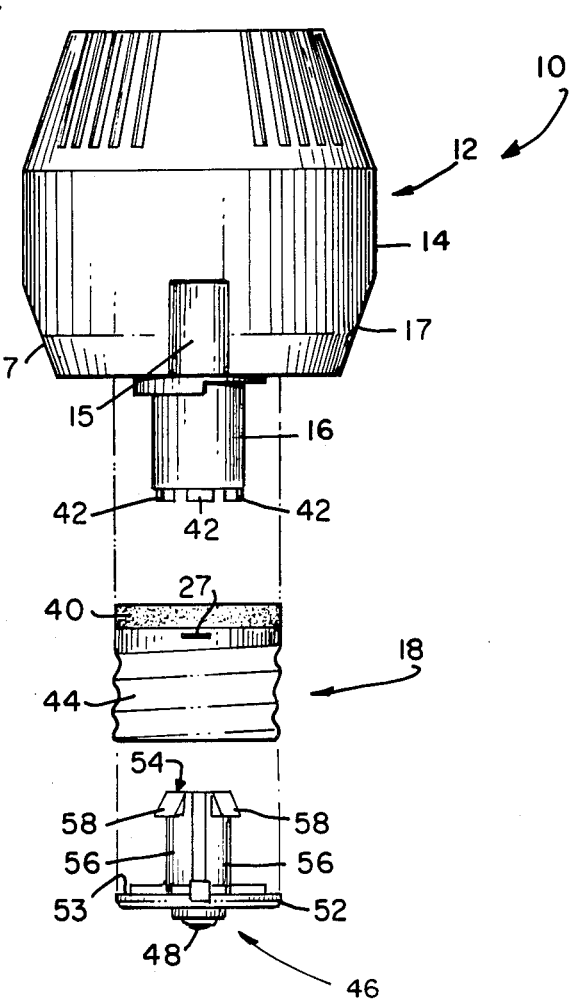
FIG. 2 is an exploded view of the lamp holder assembly of FIG. 1.
Figure 5:
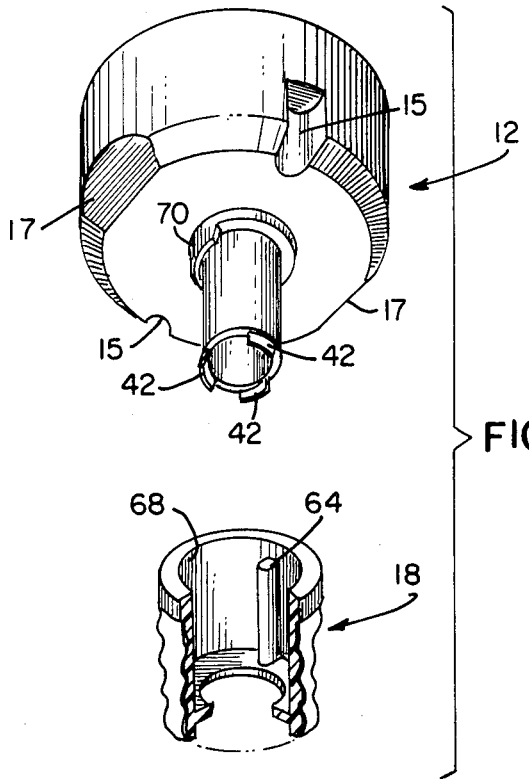
FIG. 5 is an exploded, partially sectional perspective view of the lamp holder assembly of FIG. 1.

Referring now to the drawings with greater particularity, there is shown in FIG. 1 a lamp holder assembly 10 for the socket of an incandescent lamp fixture. Lamp 11 can be of the fluorescent variety and can have the shape as shown in FIG. 1. As shown in FIG. 2 lamp holder assembly 10 comprises a first housing 12 having a central body portion 14 and a protruding portion 16 located at one end of first housing 12. The central body portion 14 can have local clearances (e.g., diametrically opposed slots, grooves 15, or flats 17 as best shown in FIG. 5) formed in the housing for accommodating structural elements of the fixtures, such as the harp of a table lamp, thereby requiring alignment of the housing in relation to the harp. A base shell 18 surrounds protruding portion 16 of first housing 12. A retainer member 46 as described hereinafter is secured to protruding portion 16 of first housing 12.

Figure 3:
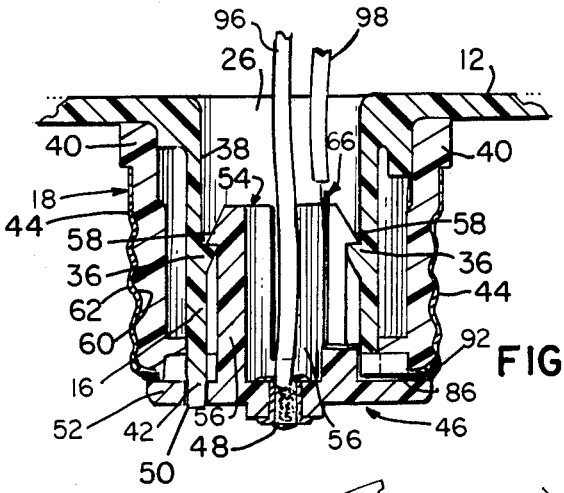
FIG. 3 is an enlarged cross-sectional view of the protruding portion of the lamp holder assembly of FIG. 1.

In the cross-sectional view in FIG. 3, base shell 18 includes an insulative second housing 40 having an electrically conductive shell 44 attached thereto. To strengthen electrically conductive shell 44 for axial loading, insulative second housing 40 on base shell 18 can be provided with an external screw thread 60, and electrically conductive shell 44 can have an internal screw thread 62 which mates with external screw thread 60. Electrically conductive shell 44 and insulative second housing 40 can be fixed together by means of a staple 27 (FIGS. 1 and 2).

Figure 4:
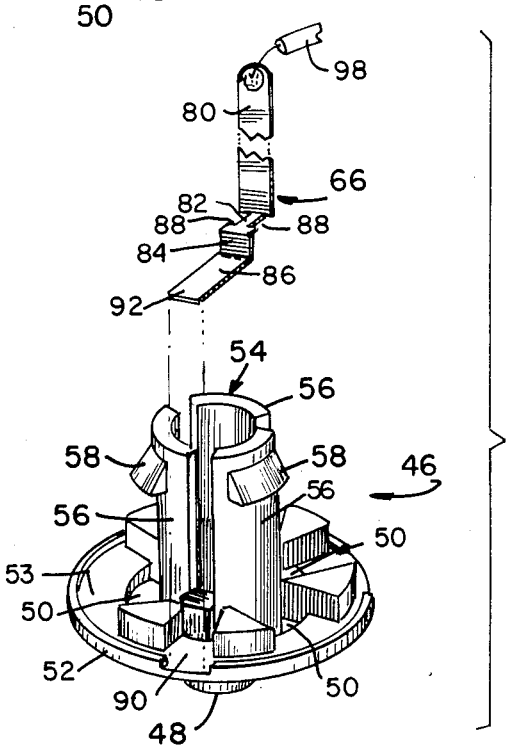
FIG. 4 is an enlarged perspective view of the retainer member and the second electrical contact means of the lamp holder assembly of FIG. 1.

In accordance with the invention as shown in FIGS. 2, 3 and 4, lamp holder 10 further comprises a retainer member 46 secured to protruding portion 16 of first housing 12. Retainer member 46 includes a disk-shaped portion 52 having a first electrical contact means 48 coaxially disposed therein and a resilient protruding member 54 attached to a first surface 53 of disk-shaped portion 52. Resilient protruding member 54 projects longitudinally within a cavity 26 defined by protruding portion 16 of first housing 12.

The internal surface 38 of protruding portion 16 of first housing 12 is provided with an inwardly extending circumferential rim 36. Resilient protruding member 54 of retainer member 46 includes a plurality of prongs 56, each of prongs 56 is provided with an outwardly extending ridge 58 located at one end thereof. Retainer member 46 and protruding portion 16 of first housing 12 are snapped or pushed together so that outwardly extending ridge 58 on prongs 56 engage rim 36, thereby securing retainer member 46 to protruding portion 16.

In a preferred embodiment of the invention as best shown in FIGS. 2, 3 and 4, protruding portion 16 of first housing 12 includes at least one tab 42 projecting longitudinally. Retainer member 46 has at least one slot 50 formed in disk-shaped portion 52 adjacent first electrical contact means 48 for receiving tab 42 from protruding portion 16 and allowing mechanical coupling of retainer member 46 to first housing 12. Preferably, protruding portion 16 of first housing 12 includes a plurality of tabs 42 projecting longitudinally and retainer member 46 has a plurality of slots 50 formed in disk-shaped portion 52 and disposed concentrically about first electrical contact means 48 for receiving plurality of tabs 42.

The first housing 12 of the lamp holder assembly 10 can be hollow and contain therewithin a ballast (not shown) for the lamp which can comprise a transformer, glow starter switch and associated capacitor. Alternatively, the glow starter switch and capacitor can be included within the base of the lamp. The necessary electrical connections to the base portion can be made by soldering a first electrical connecting wire 96, which projects through cavity 26 of protruding portion 16, to first electrical contact means 48. A second electrical connecting wire 98 is soldered to a second electrical contact means.

Second electrical contact means includes an electrically conductive member 66 having a longitudinally extending first portion 80, a laterally extending second portion 82 attached to first portion 80, a longitudinally extending third portion 84 attached to second portion 82 and a laterally extending fourth portion 86 attached to third portion 84. Electrically conductive member 66 is secured to retainer member 46 by means of a pair of notches 88 formed in second portion 82 which engage two adjacent prongs 56 and a groove 90 formed in first surface 53 of disk-shaped portion 52 of retainer member 46 to receive third portion 84 and fourth portion 86 of electrically conductive member 66. As shown in FIG. 3 electrically conductive member 66 is adapted to contact electrically conductive shell 44. When protruding portion 16, base shell 18 and retainer member 46 are assembled, a first surface 92 of fourth portion 86 electrically engages a portion of electrically conductive shell 44 of base shell 18. When base shell 18 is rotated with respect to protruding portion 16 and retainer member 46, first surface 92 of fourth portion 86 slidably contacts electrically conductive shell 44 to provide electrical contact thereto.

Lamp holder assembly 10 is further provided with a means for permitting a predetermined amount of rotational movement of base shell 18 relative to protruding portion 16 of first housing 12 and retainer member 46. As best shown in FIG. 5, rotational movement means preferably includes a rib 64 secured to or forming part of base shell 18 and projecting therefrom and stop means secured to or forming part of first housing 12 and disposed relative to base shell 18 for engaging rib 64.

Figure 6:
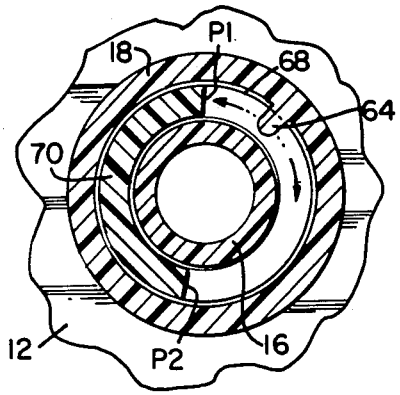
FIG. 6 is a view of a preferred embodiment taken along the line 6—6 of FIG. 1.
Figure 7:
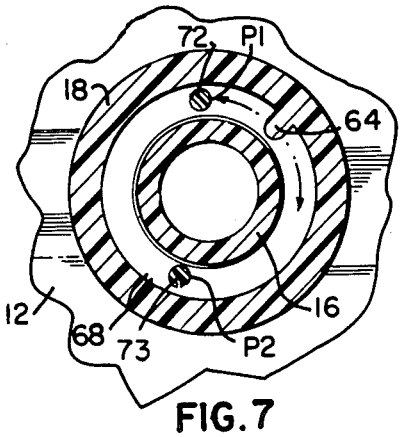
FIGS. 7–9 are views taken along the line 6—6 of FIG. 1 showing further embodiments of the invention.

In a preferred embodiment, rib 64 is located on the internal surface 68 of base shell 18 (FIGS. 5–7). Stop means includes at least a first projecting member 70 located on first housing 12 adjacent internal surface 68 of base shell 18. In an alternative embodiment shown in FIG. 7, stop means includes two projecting members 72 and 73 spacedly located on first housing 12 adjacent internal surface 68 of base shell 18.

Figure 8:
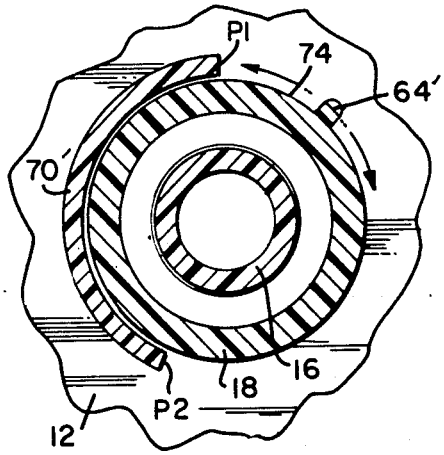
Figure 9:
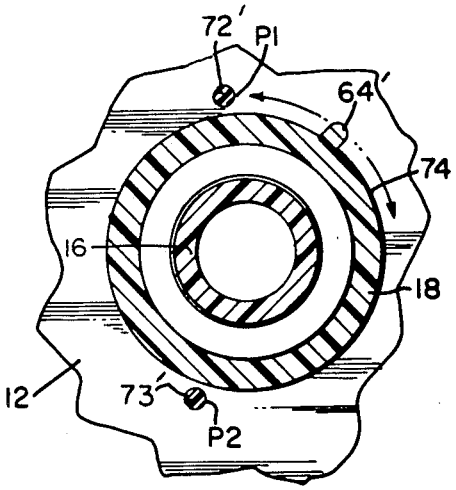

FIGS. 8 and 9 show further embodiments in which rib 64' is located on the external surface 74 of base shell 18. In FIG. 8, stop means includes at least a first projecting member 70' located on first housing 12 adjacent external surface 74 of base shell 18.

Alternatively, in FIG. 9, stop means includes two projecting members 72' and 73' spacedly located on first housing 12 adjacent external surface 74 of base shell 18.

First projecting member 70 or 70' can be arcuate in shape as shown in FIGS. 6 and 8.

Stop means engages rib 64 or 64' at two spaced apart positions (P1 and P2) of movement of rib 64 or 64'. The distance between spaced apart positions P1 and P2 travelled by rib 64 or 64' define the amount of rotational movement, which preferably is about 180°. Once firmly seated in the socket of an incandescent fixture, the lamp holder assembly can be rotated counterclockwise up to 180° without losing electrical contact. This unique feature allows alignment of the housing with respect to the legs of a table lamp harp. The amount of rotational movement can be adjusted to another desired amount by increasing or decreasing the rib 64 or 64' travelling distance between P1 and P2.

While there have been shown and described what are at present considered to be the preferred embodiments of the invention, it will be apparent to those skilled in the art that various changes and modifications can be made herein without departing from the scope of the invention as defined by the appended claims.

I claim:

1. A lamp holder assembly comprising:

a first housing having a central body portion and a protruding portion located at one end of said first housing:

a base shell surrounding said protruding portion of said first housing;

a retainer member secured to said protruding portion of said first housing; and means for permitting a predetermined amount of rotational movement of said base shell relative to said protruding portion and said retainer member.

2. The lamp holder assembly of claim 1 wherein said amount of said rotational movement is about 180°.

3. The lamp holder assembly of claim 1 wherein said means for permitting said predetermined amount of rotational movement of said base shell relative to said protruding portion and said retainer member comprises:

a rib secured to or forming part of said base shell and projecting therefrom; and stop means secured to or forming part of said first housing and disposed relative to said base shell for engaging said rib at two spaced apart positions of movement of said rib, said spaced apart positions defining said amount of said rotational movement.

4. The lamp holder assembly of claim 3 wherein said rib is located on the internal surface of said base shell.

5. The lamp holder assembly of claim 4 wherein said stop means includes two projecting members spacedly located on said first housing adjacent said internal surface of said base shell.

6. The lamp holder assembly of claim 4 wherein said stop means includes at least a first projecting member located on said first housing adjacent said internal surface of said base shell.

7. The lamp holder assembly of claim 6 wherein said first projecting member is arcuate in shape.

8. The lamp holder assembly of claim 3 wherein said rib is located on the external surface of said base shell.

9. The lamp holder assembly of claim 8 wherein said stop means includes two projecting members spacedly located on said first housing adjacent said external surface of said base shell.

10. The lamp holder assembly of claim 8 wherein said stop means includes at least a first projecting member located on said first housing adjacent said external surface of said base shell.

11. The lamp holder assembly of claim 10 wherein said first projecting member is arcuate in shape.

12. The lamp holder assembly of claim 1 wherein said base shell includes an insulative second housing having an electrically conductive shell attached thereto.

13. The lamp holder assembly of claim 12 wherein said insulative second housing of said base shell is provided with an external screw thread, and said electrically conductive shell has an internal thread which mates therewith.

14. The lamp holder assembly of claim 1 wherein said retainer member includes a disk-shaped portion having a first electrical contact means coaxially disposed therein and a resilient protruding member attached to a first surface of said disk-shaped portion, said protruding portion of said first housing defines a cavity and said resilient protruding member of said retainer member projects longitudinally within said cavity.

15. The lamp holder assembly of claim 14 wherein the internal surface of said protruding portion of said first housing is provided with an inwardly extending circumferential rim, and said resilient protruding member of said retainer member includes a plurality of prongs, each of said prongs is provided with an outwardly extending ridge located at one end thereof for engaging said rim.

16. The lamp holder assembly of claim 14 wherein said protruding portion of said first housing includes at least one tab protruding longitudinally, and said retainer member having at least one slot formed in said disk-shaped portion adjacent said first electrical contact means for receiving said tab.

17. The lamp holder assembly of claim 16 wherein said protruding portion of said first housing includes a plurality of tabs projecting longitudinally, and said retainer member having a plurality of slots formed in said disk-shaped portion and disposed concentrically about said first electrical contact means for receiving said plurality of tabs.

18. The lamp holder assembly of claim 1 further including a second electrical contact means comprising an electrically conductive member secured to said retainer member and adapted to slidably contact said electrically conductive shell.

19. The lamp holder of claim 18 wherein said electrically conductive member includes a longitudinally extending first portion, a laterally extending second portion attached to said first portion, a longitudinally extending third portion attached to said second portion and a laterally extending fourth portion attached to said third portion.

20. The lamp holder assembly of claim 19 wherein said electrically conductive member is secured to said retainer member by means of a pair of notches formed in said second portion and said retainer member having a first surface with a groove formed therein to receive said longitudinally extending third portion and said laterally extending fourth portion of said electrically conductive member.

* * * * *